US005720589A

United States Patent [19]

Christenson et al.

[11] Patent Number: 5,720,589

[45] Date of Patent: Feb. 24, 1998

[54] SWIVEL MOUNTED CONTAINER HOLDING DEVICE

[75] Inventors: Ronald E. Christenson, Parsons, Tenn.; Garwin McNeilus, Dodge Center, Minn.

[73] Assignee: McNeilus Truck and Manufacturing, Inc., Dodge Center, Minn.

[21] Appl. No.: 596,648

[22] Filed: Feb. 5, 1996

Related U.S. Application Data

[63] Continuation-in-part of Ser. No. 515,815, Aug. 16, 1995.

[51] Int. Cl.[6] ..... B65F 3/04

[52] U.S. Cl. ..... 414/408; 414/550; 414/555; 414/738

[58] Field of Search ..... 414/406, 408, 414/546, 547, 550, 555, 917, 738, 742, 680, 486

[56] References Cited

U.S. PATENT DOCUMENTS

| | | | |
|---|---|---|---|
| 3,487,964 | 1/1970 | Riley | 414/550 |
| 3,762,586 | 10/1973 | Updike, Jr. | 414/408 |
| 3,765,554 | 10/1973 | Morrison | 414/408 |
| 3,796,331 | 3/1974 | Dutton | 414/555 X |
| 3,841,508 | 10/1974 | Ebeling et al. | 414/406 |
| 3,954,194 | 5/1976 | Stedman | 414/555 X |
| 4,091,943 | 5/1978 | Bay-Schmith | 414/555 X |
| 4,175,903 | 11/1979 | Carson | 414/408 |
| 4,983,092 | 1/1991 | Richards | 414/408 |
| 5,092,731 | 3/1992 | Jones et al. | 414/406 |
| 5,209,537 | 5/1993 | Smith et al. | 414/408 X |
| 5,330,308 | 7/1994 | Armando et al. | 414/408 |
| 5,391,039 | 2/1995 | Holtom | 414/408 |
| 5,437,531 | 8/1995 | Kress | 414/555 |
| 5,562,386 | 10/1996 | Browning | 414/408 |

FOREIGN PATENT DOCUMENTS

| | | | |
|---|---|---|---|
| 0 312 900 A2 | 4/1989 | European Pat. Off. . | |
| 0 695 702 A1 | 8/1995 | European Pat. Off. . | |
| 0 684 193 A2 | 11/1995 | European Pat. Off. . | |
| 3546070 | 7/1987 | Germany | 414/550 |
| 9827 | 1/1979 | Japan | 414/406 |
| 604541 | 4/1978 | U.S.S.R. | 414/555 |
| 1043077 | 9/1983 | U.S.S.R. | 414/408 |
| 1161433 | 6/1985 | U.S.S.R. | 414/408 |
| 1247316 | 7/1986 | U.S.S.R. | 414/408 |

*Primary Examiner*—David A. Bucci
*Attorney, Agent, or Firm*—Haugen and Nikolai, P.A.

[57] ABSTRACT

Vehicle mounted container handling devices including a rotating swivel mount and an articulated arm connected to the swivel mount are disclosed. The swivel mount includes a housing operable to rotate about a shaft in a first plane. The articulated arm is attached at one end to the housing and disposed to pivot in a second plane which intersects the first plane. A grasping device is pivotally connected to the free end of the articulated arm for pivoting in the second plane. In operation, with the grasping device opened, the articulated arm is extended to reach out toward a container of interest. The swivel mount is operated to pivot the articulated arm as required for the grasping device to engage the container. The articulated arm is operated further to lift and dump the container in the vehicle above the swivel mount. The grasping device includes arms pivotally connected to a support member and moved by actuators pivotally connected between the arms and the support member.

12 Claims, 17 Drawing Sheets

SWIVEL MOUNTED CONTAINER HOLDING DEVICE

This application is a continuation-in-part of application Ser. No. 08/515,815, filed Aug. 16, 1995, entitled "SWIVEL MOUNTED CONTAINER HOLDING DEVICE".

BACKGROUND OF THE INVENTION

I. Field of the Invention

This invention relates generally to material handling equipment and, more particularly, to a lifting device attached to a refuse vehicle for handling containers during collection efforts.

II. Related Art

Mechanized material handling devices often include a container holder or grasping device connected to an arm which is connected to a base, such as a vehicle. The arm and grasping device are operated to engage a container of interest, lift and dump the container into a receiving hopper in the vehicle.

A representative example of such a device appears in U.S. Pat. No. 5,391,039, issued to Holtom, which describes a refuse loader arm including a lift limb and a reach limb articulated to one another at a pivot point. The lift limb is vertically pivotally attached at one end to a refuse vehicle and the reach limb is articulated at its other end to a bin grasping assembly which is held at a constant angle to the lift limb by a parallelogram linkage. The lift limb and the reach limb pivot in a common plane to reach out and grasp the container of interest and lift and dump the container. Of course, the vehicle must be positioned directly alongside such that the container is aligned with the pivoting plane of the arm. U.S. Pat. No. 5,330,308, issued to Armando et al., describes a refuse container loading device including a tubular support attached to a refuse vehicle, operable to pivot in a horizontal plane. A telescoping arm that pivots vertically is attached to the base and to a bin grasping device that is able to pivot vertically and swivel horizontally.

Similarly, U.S. Pat. No. 4,175,903, issued to Carson, describes an apparatus for picking up containers wherein a boom arm is attached to a platform which is pivotally attached to a refuse vehicle for rotating in a generally horizontal plane. The boom arm is pivotally attached to the platform for pivoting vertically to raise and dump a container. A pick-up arm is provided to grasp the container and is attached to the boom arm with the ability to rotate in essentially a horizontal plane. Using the devices described in the '308 and '903 patents eliminates the need for precise positioning of the vehicle. But, the lift and dump arms are quite complex.

A principle object of the invention then is to provide an improved lifting device for handling objects or containers of interest.

Another object of the invention is to provide a relatively simple lifting device attached to a vehicle which eliminates the need for precise positioning of the vehicle.

Still another object of the invention is to provide a lifting device which includes an articulated arm disposed to pivot in one plane and rotatably attached to the vehicle for swiveling in another plane.

Yet another object of the invention is to provide a lifting device which operates in two planes and includes a bin grasping device.

A further object of the invention is to provide a lifting device including an articulated arm disposed to pivot in one plane and rotatably attached to a refuse vehicle for pivoting in another plane and including a grasping device pivotally attached to the articulated arm for pivoting in the same plane as the articulated arm.

Other objects, features, and advantages of the present invention will become apparent to those skilled in the art through familiarity with the summary of the invention, detailed description, claims, and drawings herein.

SUMMARY OF THE INVENTION

The foregoing and other objects of the present invention, are attained by providing a lifting device including a swivel mount or turret which rotates in a generally horizontal plane, i.e., parallel to the deck of a vehicle on which it is mounted such as a refuse vehicle and an articulated arm connected to the swivel mount. The swivel mount includes a housing which rotates about a shaft connected to one or more support plates which are, in turn, attached to the vehicle. The articulated arm is attached to the housing and includes first and second arm members joined or articulated to one another, at one end. The first arm member is pivotally attached at a second end to an arm pivot support attached to the housing and the second arm member has a free end which carries a gripping or grasping mechanism. The articulated arm pivots in a generally vertical plane to provide a lift and dump function.

In one embodiment, the swivel mount includes a base plate attached to the frame of a vehicle and upper and lower parallel pivot plates attached to the base plate and carrying a shaft therebetween. The housing member is engaged on the shaft and a lever arm is attached to the housing member. The lever arm or crank is connected to the rod end of a hydraulic cylinder attached to the frame or a frame extension of the vehicle and which reciprocates to rotate the housing member. The housing member rotates in a plane parallel to the deck or frame of the vehicle. The arm base pivot is attached to the housing member such that the articulated arm is disposed to pivot in a generally vertical plane essentially perpendicular to the plane of rotation of the swivel mount. The grasping device is pivotally connected to the second or outer arm member of the articulated arm so as to pivot in the same plane as the articulated arm. One embodiment of the grasping device further uses a plurality of opposed digits which may be articulated and which open and close to release and capture a standing container of any cross sectional shape.

In operation, at the beginning of a lift and dump cycle the digits of the grasping device are in an "as stowed" or open position and the articulated arm is extended to move the grasping device toward the container of interest. The swivel mount is pivoted to move the grasping device into engagement with the container of interest. The grasping device is operated to a closed position to grab the container and the articulated arm is operated generally vertically to lift and tip or invert the container and empty the contents into a receiving hopper of the vehicle. During the lifting and dumping operation, the swivel mount need not be operated since the arm and grasping device tilt the container above the swivel mount regardless of the selective rotational position of the swivel mount.

In another embodiment, the swivel mount includes a rotary actuator, such as a rack and pinion or beveled gears including a worm gear and planetary gear or other device such as a rotary hydraulic actuator, to pivot the housing member about a shaft which is carried by a single lower pivot plate attached to a base plate which, in turn, is fixed to the frame. The articulated arm and grasping device are attached to the housing member connected to pivot in a generally vertical plane which is perpendicular to the plane of rotation of the housing member.

One grasping device suitable for any embodiment of the invention has a pair of spaced, opposed arms or digits pivotally connected to a central support member. The arms are shaped to fit around containers of a plurality of different shapes, including curved, rectangular, hexagonal and others. The arms are pivoted between an open or retracted position in a closed or grasping position by fluid-operated actuators, such as hydraulic cylinders. The arms may be either single or plural member type arms having curvilinear shape and in one embodiment shown, the plural member or articulated dual arm embodiment is described in which each arm has an inner member pivotally connected at one end to a common support member and an outer member pivotally connected to a corresponding inner member. The fluid-operated actuators, such as double acting hydraulic cylinders, are pivotally connected between each outer member and the common support member. The pivot points of the arms are closer together and closer to the container of interest than those of the actuators on the common support to provide leverage and allow the arms to grasp the container of interest on the power stroke of the double acting hydraulic cylinders.

While the detailed embodiments are devoted to refuse trucks, the lifting device of the present invention may be mounted on other vehicles including dump trucks or used without reference to a vehicle as a stationary loader. In situations where the lifting device is attached to a vehicle, the swivel mount may be attached to either the frame (chassis) of the vehicle or to a material receiving body of the vehicle, such as the storage body of the refuse truck or dump body of a dump truck. In this configuration, the lifting device is lifted with the storage body or dumping body to a raised position during the dumping operations.

DETAILED DESCRIPTION

The swivel or rotary mounted lifting device of the present invention is particularly applicable to load refuse collection vehicles. It is characterized by a swivel or rotary mount or joint in combination with an articulated lift and dump arm having a container grasping device. The swivel or rotary mount enables a connected lift arm and grasping device or grabber to move extensively fore and aft of the mount to thereby enable the system to address containers at a variety of locations alongside the vehicle.

The swivel mount may include a linear actuator and lever arm or a rotary actuator for pivoting the swivel. The swivel mount base may be adapted to be attached to the frame or chassis, or to the body of any refuse vehicle. In the embodiments described below, the swivel mounted lifting device is attached to the frame of a side loading refuse vehicle. The side loading refuse vehicle may have an offset or recessed hopper portion but this is not required to accommodate the swivel mount system. The hopper may be recessed on the side opposite the swivel mounted lifting device to accommodate a second loading mechanism. This may be a manually loaded bucket with a mechanized dumping system. Vehicles of this type are described and shown in patent application Ser. No. 08/508,384, filed Jul. 31, 1995, titled REFUSE COLLECTION SYSTEM, the disclosure of which is hereby incorporated herein by reference for any necessary purposes.

Figure 1:
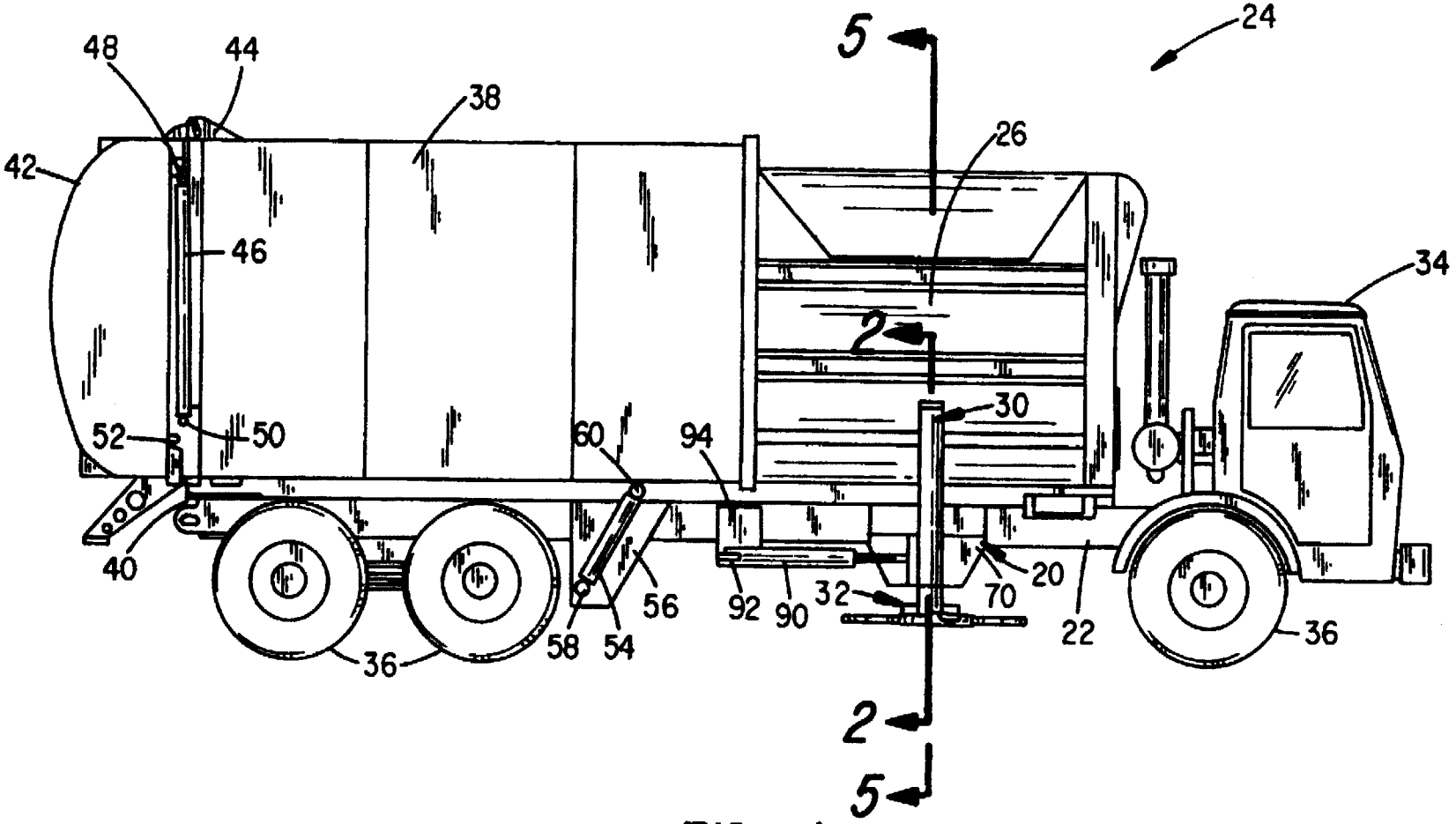
FIG. 1 is a side elevational view of a refuse collection vehicle equipped with a lifting device according to the invention.
Figure 2:
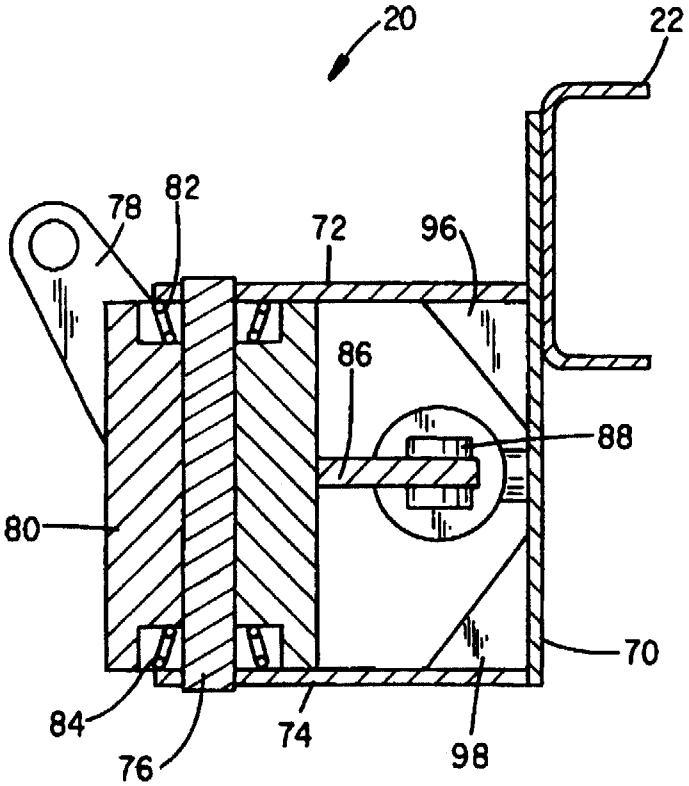
FIG. 2 depicts an enlarged view partially in section taken substantially along lines 2—2 of FIG. 1 and showing one type of hydraulically operated swivel mount.

In accordance with the drawings, and as shown in FIGS. 1 and 2 a chassis or frame mounted swivelling lifting device includes a swivel mount, generally at 20, which is attached to a main frame or chassis member 22 of a side loading refuse vehicle 24. The swivel mount 20 is attached to the frame member 22 underneath a refuse receiving or charging hopper 26 which includes a top opening 28 for receiving refuse. A hinged or pivoting lift arm, generally at 30, is pivotally connected to the swivel mount 20 and a refuse container holder or grabber, generally at, 32 is pivotally attached to the lift arm 30. As will be described below, the swivel mount enables the position of the lift arm 30 and container holder 32 to be adjusted back and forth along the length of the refuse vehicle 24 to accommodate the position of a container of interest. The grabber 32 and lift arm 30 cooperate to empty refuse containers into charging hopper 26 through opening 28. The refuse vehicle 24 need not be aligned precisely with the container of interest for grasping and tilting.

The refuse vehicle 24 includes the usual cab 34 and wheels 36 which carry a storage body 38 connected to a charging hopper 26 and pivotally attached to the frame members 22 as at 40. Storage body 38 includes a tailgate 42 which is pivotally attached by a pair of vertically displaceable hinges, one of which appears at 44, mounted at the top of the storage body 38. The tailgate 42 is operated between an open and a closed position by a pair of hydraulic cylinders, one of which is shown at 46, which are pivotally attached to the tailgate 42, as at 48, and to the storage body 38 as at 50. Side latches 52 are provided for latching the tailgate 42 to the storage body 38 in a well-known matter. The storage body is designed to tilt in conjunction with the opening of the tail gate to discharge refuse. Tilting is accomplished by a pair of side mounted hydraulic lift cylinders 54 that are pivotally attached to the frame by structural member 56 at 58 and to the storage body 38 at 60.

Figure 3:
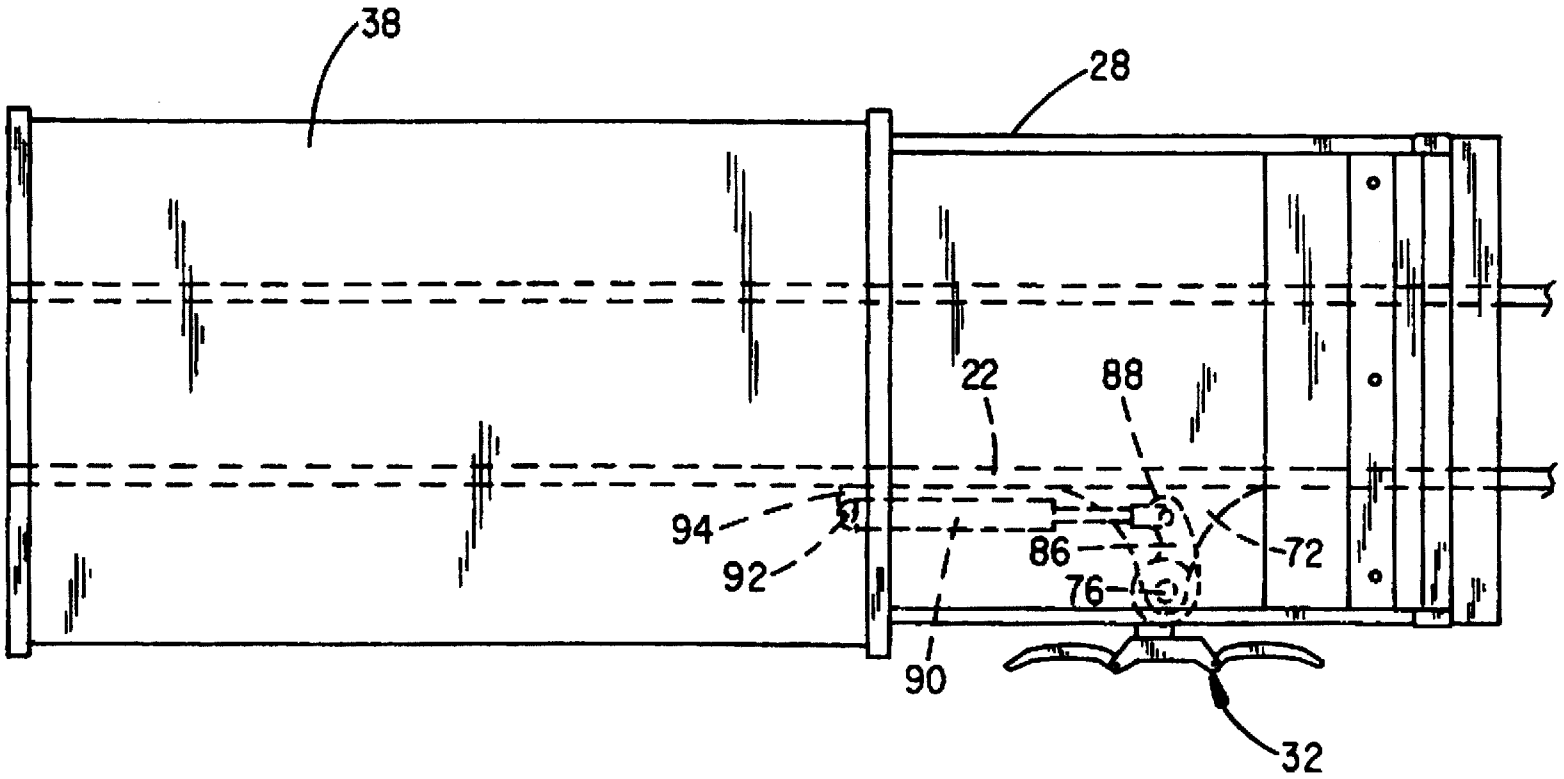
FIG. 3 is a partial top view of the refuse collection vehicle of FIG. 1 showing the hydraulic cylinder and lifting device in dashed lines.

As shown in FIGS. 1–3, the swivel mount 20 includes a base plate 70 fixed to frame member 22. Upper and lower swivel mount pivot plates 72 and 74 are attached, as by welding, to the base plate 70. A stationary shaft 76 is attached between the upper and lower pivot plates 72 and 74 and the swivel mount turns on a bearing housing 80 that rotates about the shaft 76 on spaced roller bearings 82 and 84. An arm mounting plate or member 78 is attached to the bearing housing 80. The arm mounting member 78 pivots as bearing housing 80 is rotated about shaft 76. The rotation of the housing 80 and the arm mounting member 78 is accomplished by a system including a lever or crank arm 86 attached to the bearing housing 80 and pivotally attached at 88 to a linear operator such as a hydraulic cylinder 90 (FIG. 3) which is pivotally attached at 92 to a plate member 94. Hydraulic cylinder 90 operates crank 86 to rotate or pivot bearing housing 80 and the arm pivot member about the shaft 76. Plate members 96 and 98 are attached between the base plate 70 and the upper and lower pivot plates 72 and 74 to add structural support.

Figure 4:
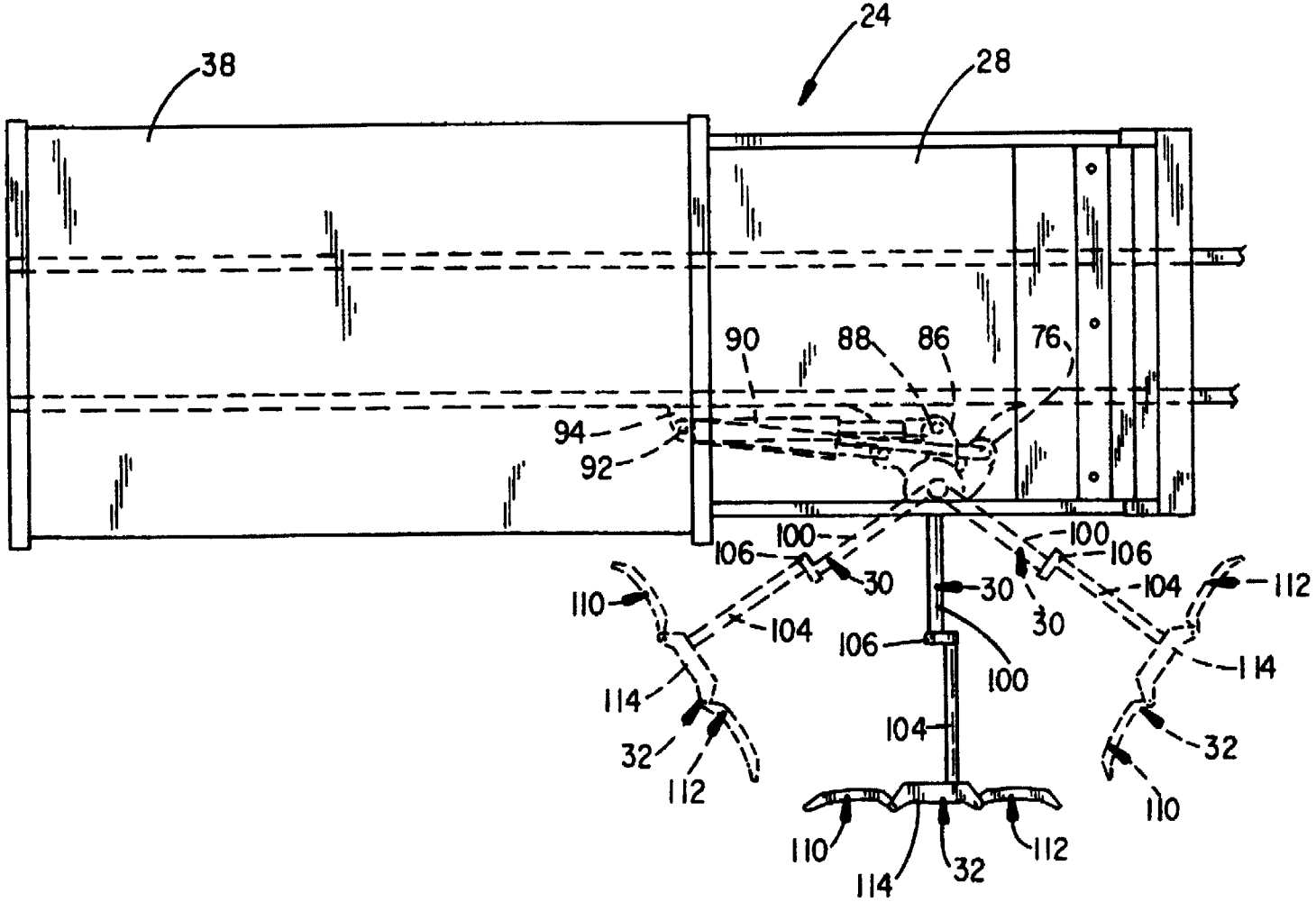
FIG. 4 is a view similar to FIG. 3 showing the articulated arm extended and the swivel mount in three different positions.
Figure 5:
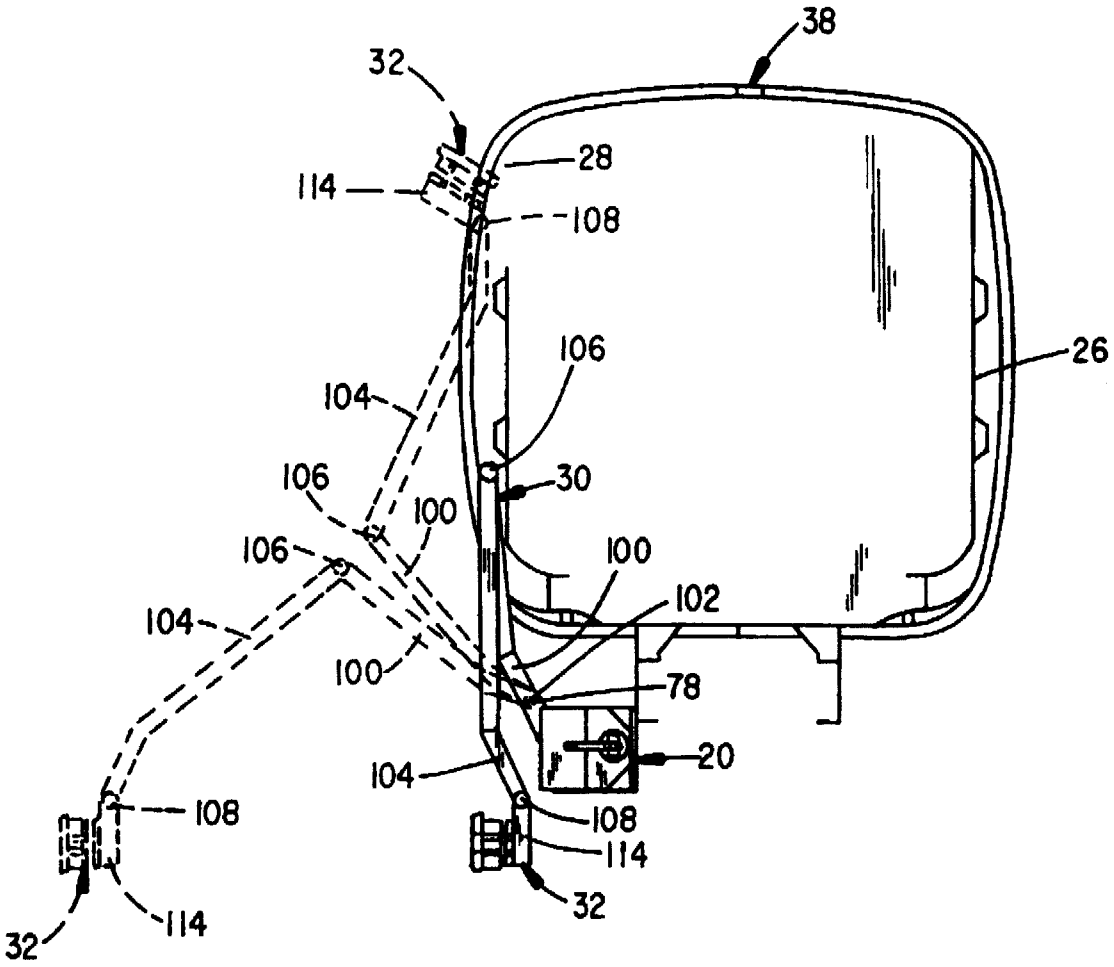
FIG. 5 is a view of the refuse collection vehicle of FIG. 1 taken substantially along lines 5—5 of FIG. 1 showing the articulated arm in the stowed position in bold lines and in the grasping and dumping positions in dashed lines.

Details of the articulated lift arm are best seen in FIGS. 4 and 5. The lift arm 30 includes a pair of connected generally vertically pivotal articulated members including a first or inner lift arm member 100 pivotally attached to the lift arm mounting member 78 at 102 and a second or outer lift arm member 104 pivotally attached to the first lift arm member 100 at 106. The refuse can holder or grabber 32 is pivotally attached to the outer lift arm member 104 at 108. The lift arm 30 may be operated by hydraulic cylinders or rotary actuators at the pivots 102, 106, and 108 to extend the lift arm 30 for grasping the container of interest and lifting and dumping the container into the refuse charging hopper 26. Of course, the lift arm 30 is not limited to the embodiment shown and may be any suitable lift arm attached to the bearing housing 80. Extending and retracting hydraulic cylinder 90 rotates or pivots the lift arm 30 about shaft 76 to position the container grabber 32 along the length of the refuse vehicle 24. The swivel cylinder 90 and the lift arm 30 and container grabber or grasping device 32 cooperate to grasp a container of interest, lift, invert, and dump it into the refuse charging hopper 26 through opening 28.

In a stowed position, as shown in FIGS. 1 and 3 and depicted in FIG. 5 in solid lines, the lift arm 30 is pulled in next to the hopper 26 and the container grabber 32 is retracted to the open (flat) position. This holds the container grabber or grasping device 32 substantially in line with one side of the storage body 38.

Figure 6:
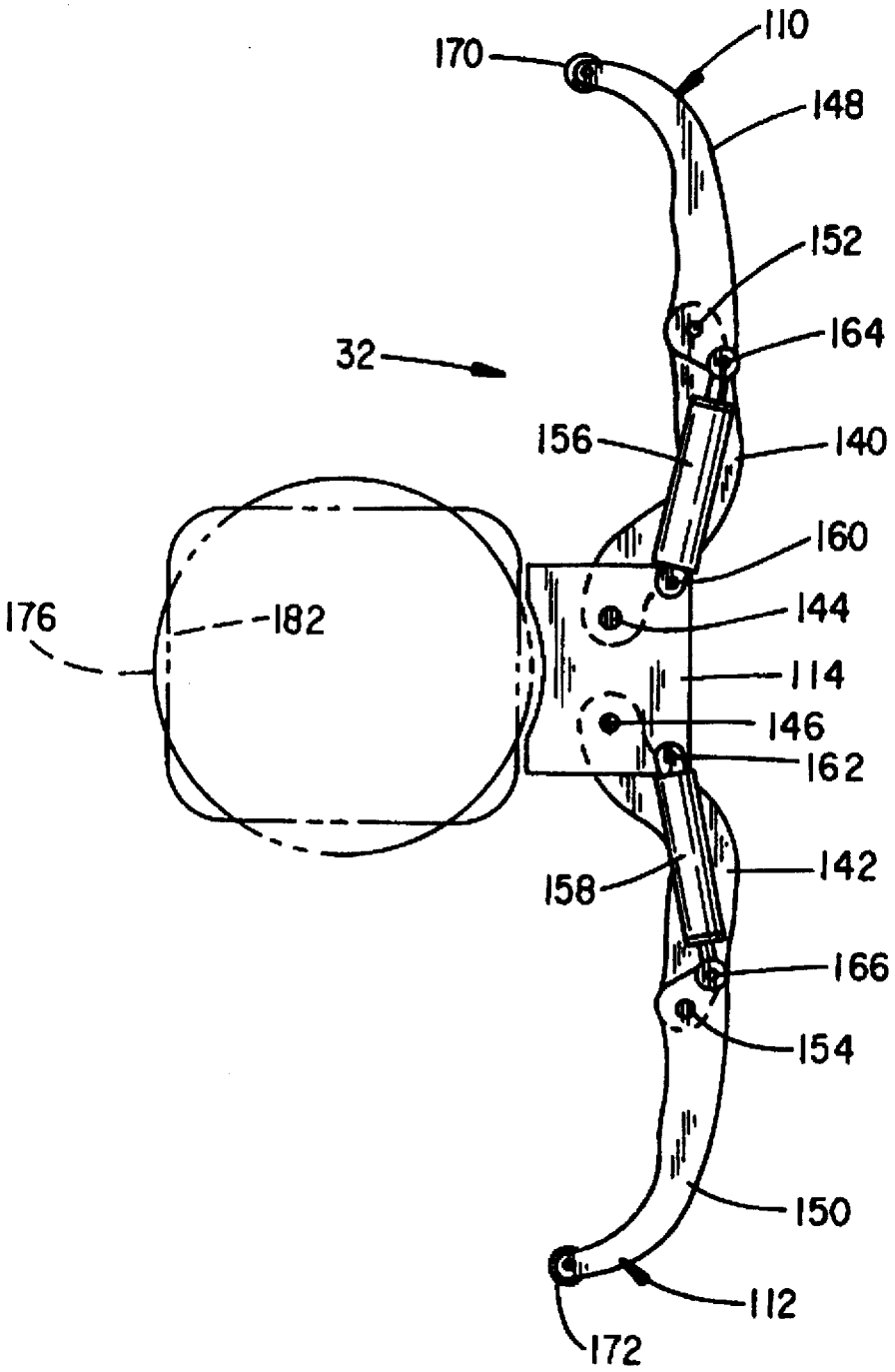
FIG. 6 is a top view of the grasping device in the open as stowed position.
Figure 7:
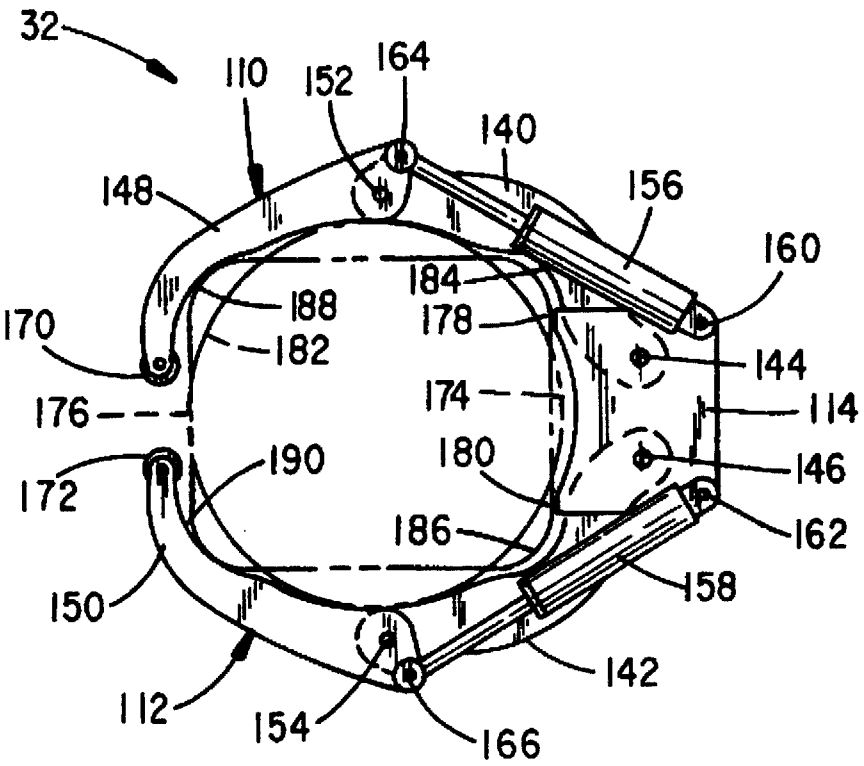
FIG. 7 is a top view of the grasping device in the closed or grasping position.

Details of one grasping device are shown in FIGS. 4–7. Addition detail and embodiments may be had by consulting U.S. patent application Ser. No. 08/342,752, entitled CONTAINER HOLDING AND LIFTING DEVICE, filed Nov. 21, 1994 and assigned to the same assignee as the present application, the disclosure of which is hereby incorporated by referenced herein for any necessary purpose. The refuse container grabber 32 itself includes first and second opposed compound arms 110 and 112 which are pivotally attached to support member 114 which, in turn, is pivotally attached to outer lift arm member 104 at 108. The opposed arms 110 and 112 are operated by hydraulic cylinders or rotary actuators between an open or stowed position (FIG. 6) and a closed or grasping position (FIG. 7).

Details of the grabber are more clearly shown in the enlarged views of FIGS. 6 and 7. Arms 110 and 112 include inner members 140 and 142 pivotally connected to the support member 114 at first support pivot points 144 and 146 and pivotally connected to outer members 148 and 150 at arm member pivot points 152 and 154. Linear actuators 156 and 158, preferably hydraulic cylinders, are pivotally connected to the support member 114 at second support pivot points 160 and 162 and to outer members 148 and 150 at offset pivot points 164 and 166.

Hydraulic cylinder actuators 156 and 158, are expanded to accomplish the gripping or grasping operation. Inner members 140 and 142 close around a container of interest and outer members 148 and 150 pivot about points 152 and 154 to contact and grasp the container of interest pulling it toward supporting member 114. Contact rollers 170 and 172 carried by the outer members 148 and 150 operate to urge containers of a plurality of different shapes toward and securely hold the containers against the support member 114. Hydraulic cylinder actuators 156 and 158 are retracted to reverse this sequence and open the grasping device 32 to the position shown in FIG. 6.

The support member 114 has a rounded centered recess surface at 174 to receive a rounded or circular container 176 flanked by a pair of flat surface segments 178 and 180 which accommodate a rectangular container 182. The grasping device 32, then, holds either a rounded container or a rectangular container 182 with equal dexterity. Inner members 140 and 142 have first corresponding and opposed shaped inner surfaces 184 and 186 and outer members 148 and 150 have second corresponding and opposed shaped inner surfaces 188 and 190 to fit around the corners of a rectangular container 182. Together, inner members 140 and 142 and outer members 148 and 150 produce a smooth rounded surface for holding a rounded container 176.

Round and rectangular shaped containers are representative of the diverse variety of shapes the grasping device can successfully engage. Other shapes that can be grasped include hexagonal and oblong shapes.

Figure 8:
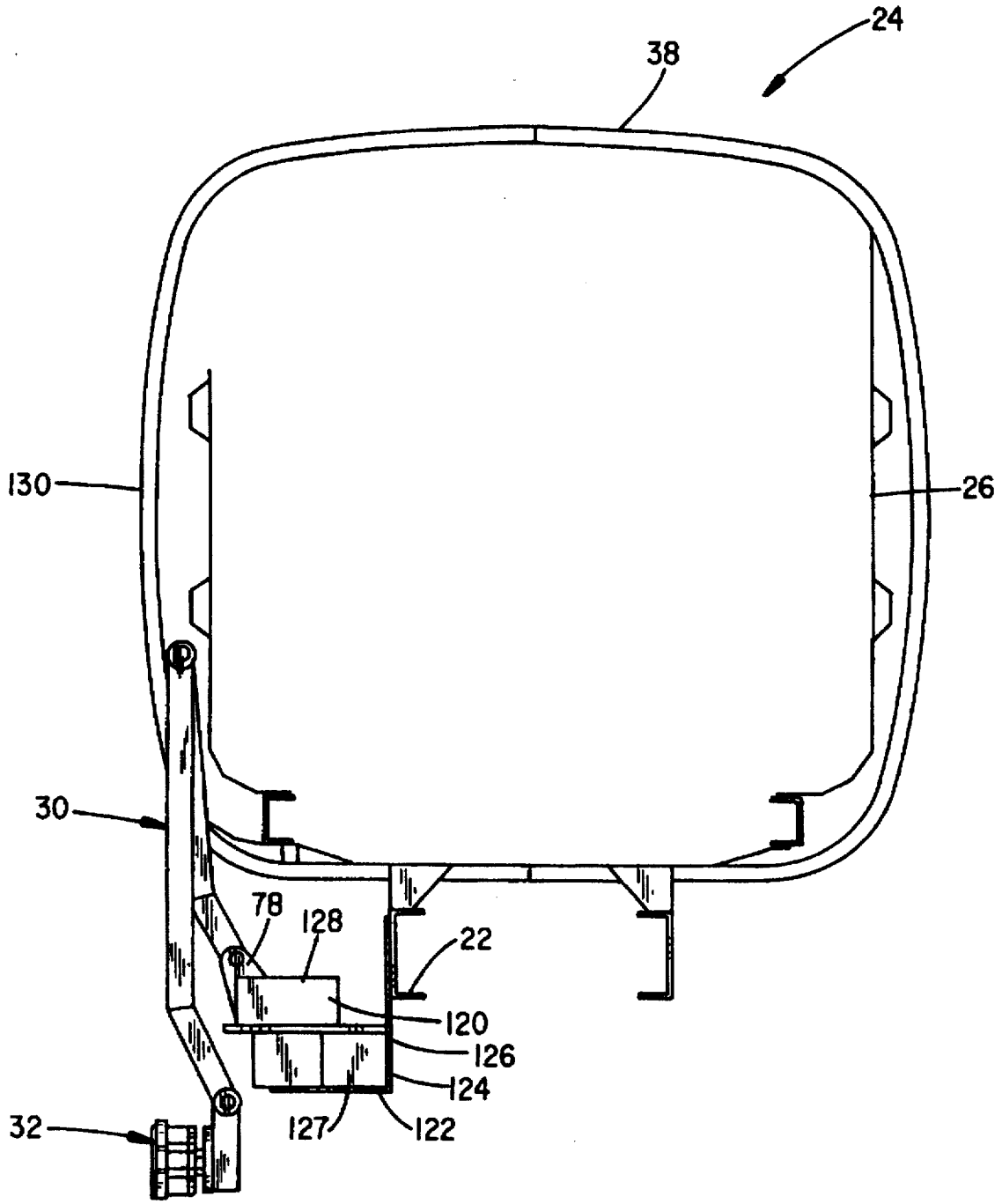
FIG. 8 is an enlarged view similar to that of FIG. 5 showing a rotatory swivel actuator.

In another embodiment, depicted in FIG. 8, the hydraulic cylinder-operated swivel mount support and operating system is replaced by a rotary actuator, indicated by the numeral 120, which may be any type of rotary actuator including rotary hydraulic actuator, a rotating piston, planetary and worm gear arrangement, rack and pinion, etc. The rotary actuator 120 is attached to a pivot plate 122 which is carried by a base plate 124 which, in turn, is attached to frame member 22. An actuator support plate 126 is attached to the base plate and additional support is provided by member 127. The rotary actuator 120 carries lever arm mounting plate member 78 and rotates about 128 to pivot the lift arm 30 and container grabber 32 along the length of the vehicle 24. The lift arm 30 and container grasping device 32 are aligned with a container using the rotary actuator 120 to grasp and dump containers into the hopper 26.

The refuse received in the charging hopper 26, of course, is moved and packed through the hopper into the storage body 38 in a well known manner. This system may employ a packing ram or rotary packer, for example.

In the stowed position, as shown in FIG. 8, the lift arm 30 is retracted close to the hopper 26 and the container grabber or grasping device 32 is left in the open position. The container grasping device 32 and lift arm 30 are essentially in line with the side 130 of the storage body 38. In this manner the loading device does not protrude beyond the side of the storage body when the truck is operated between pick-up stops. Thus, the system does not necessitate a deeply recessed charging hopper 26.

Figure 9:
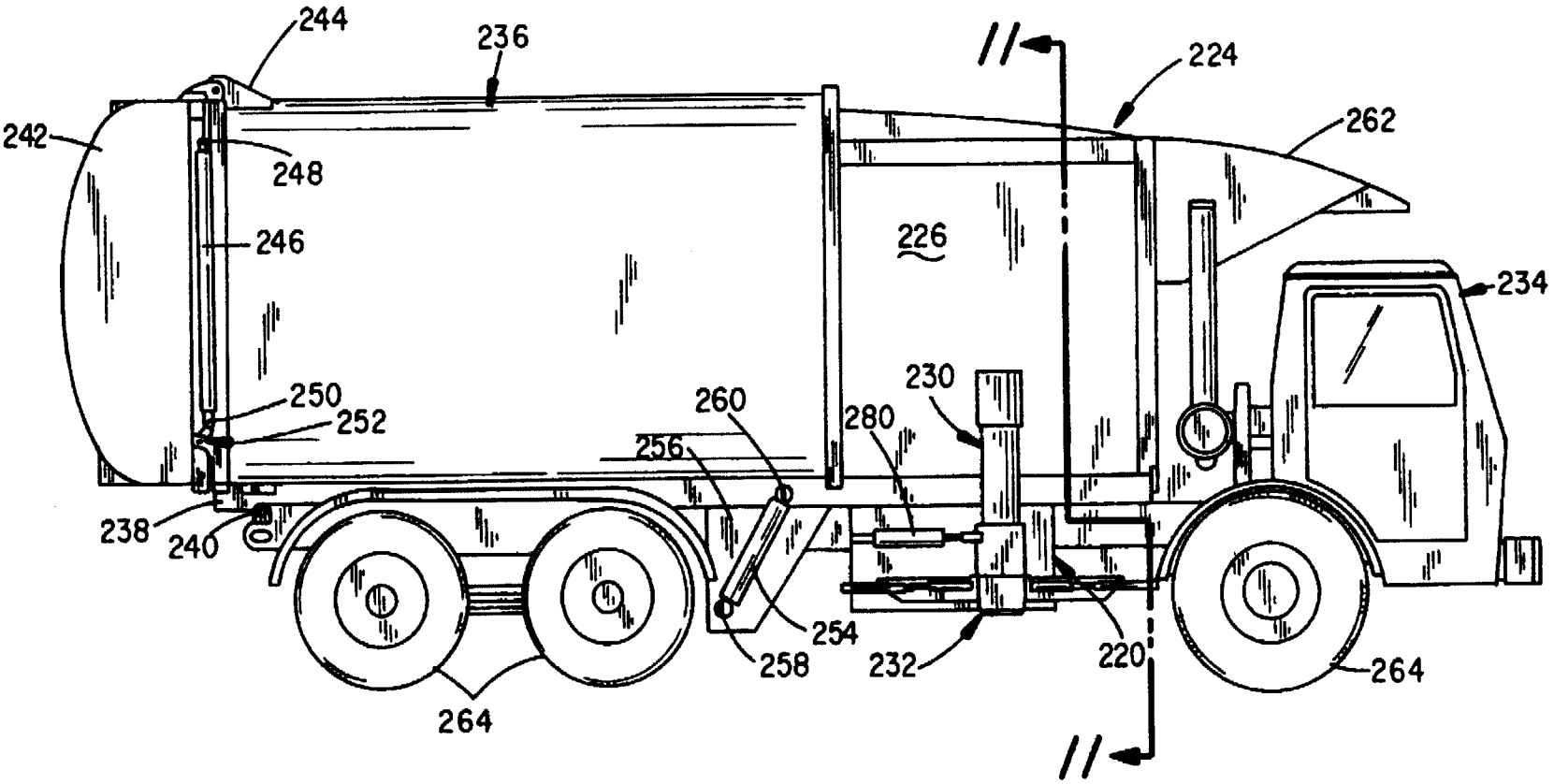
FIG. 9 is a side elevational view of a refuse collection vehicle similar to that of FIG. 1 equipped with a more detailed container lifting device.
Figure 10:
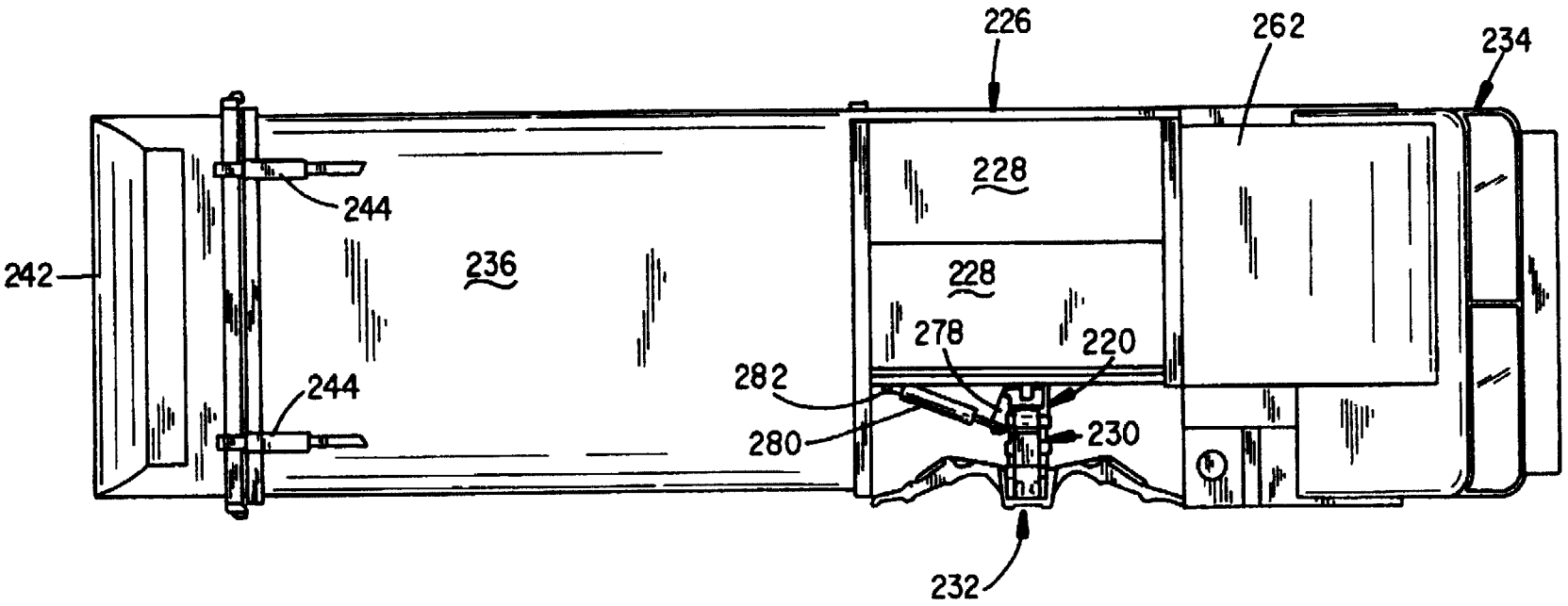
FIG. 10 is a top view of the refuse collection vehicle of FIG. 9 with the container handling device in a stowed position.

A modified handling device is shown in the figures beginning with FIG. 9 which depicts the articulated extendable lift-and-dump arm of the invention in greater detail. Accordingly, FIGS. 9 and 10 depict a chassis or frame mounted swiveling container handling device that includes a swivel mount, generally 220, which is attached to one of two main frame or chassis members 222 and 222*a* (FIG. 11) of a side loading refuse vehicle 224. The swivel mount 220 is attached to the frame member 222 by a heavy plate member 225 fixed underneath the side of recessed or offset refuse receiving or charging hopper 226. The hopper includes a top opening 228 dedicated to receive refuse for compacting. The hinged, articulated pivoting lift arm system is shown generally at 230 and is pivotally connected between swivel mount 220 at a fixed end and a refuse container seizing and holding system or grabber system, generally at 232 attached to the free end thereof. As will be described in greater detail below, the extendable arm and swivel mount combination enables the position of the lift arm 230 and container holder 232 to be adjusted laterally and back and forth along the length of the refuse vehicle 224 to accommodate handling a container of interest anywhere within a relatively extensive range. The grabber system 232 and handling arm 230 cooperate to approach, seize, lift, empty, and return refuse containers into charging hopper 226 through opening 228. As stated, curbside refuse containers need not be aligned at a particular spot or be particularly close to the truck so long as they are in the range of the extendable arm.

The refuse vehicle 224 of FIG. 9 as with that of FIG. 1 includes a cab 234 and a storage body 236 connected to receive material from charging hopper 226 carried on a common sub-frame 238 which, in turn, may be pivotally attached to heavy chassis frame members 222, 222*a*, as at 240. Storage body 236 includes a tailgate 242 which is pivotally carried by a pair of hinges, one of which appears at 244, mounted at the top of the storage body 236. The tailgate 242 is operated between an open and a closed position by a pair of hydraulic cylinders, one of which is shown at 246, which are pivotally attached to the tailgate 242, as at 248, and to the storage body 236, as at 250. Side latches as at 252 are provided for latching tailgate 242 to the storage body 236 in a well-known manner. The tailgate is designed to open in conjunction with the tilting of the storage body to discharge refuse. Tilting is accomplished by a pair of spaced side mounted hydraulic lift cylinders, one of which appears at 254, that are pivotally attached between the frame by a heavy lug or gusset member 256 at 258 and to the storage body sub-frame 238 at 260. A cab protector is shown at 262 and the entire system is supported by a plurality of wheels 264.

Figure 11:
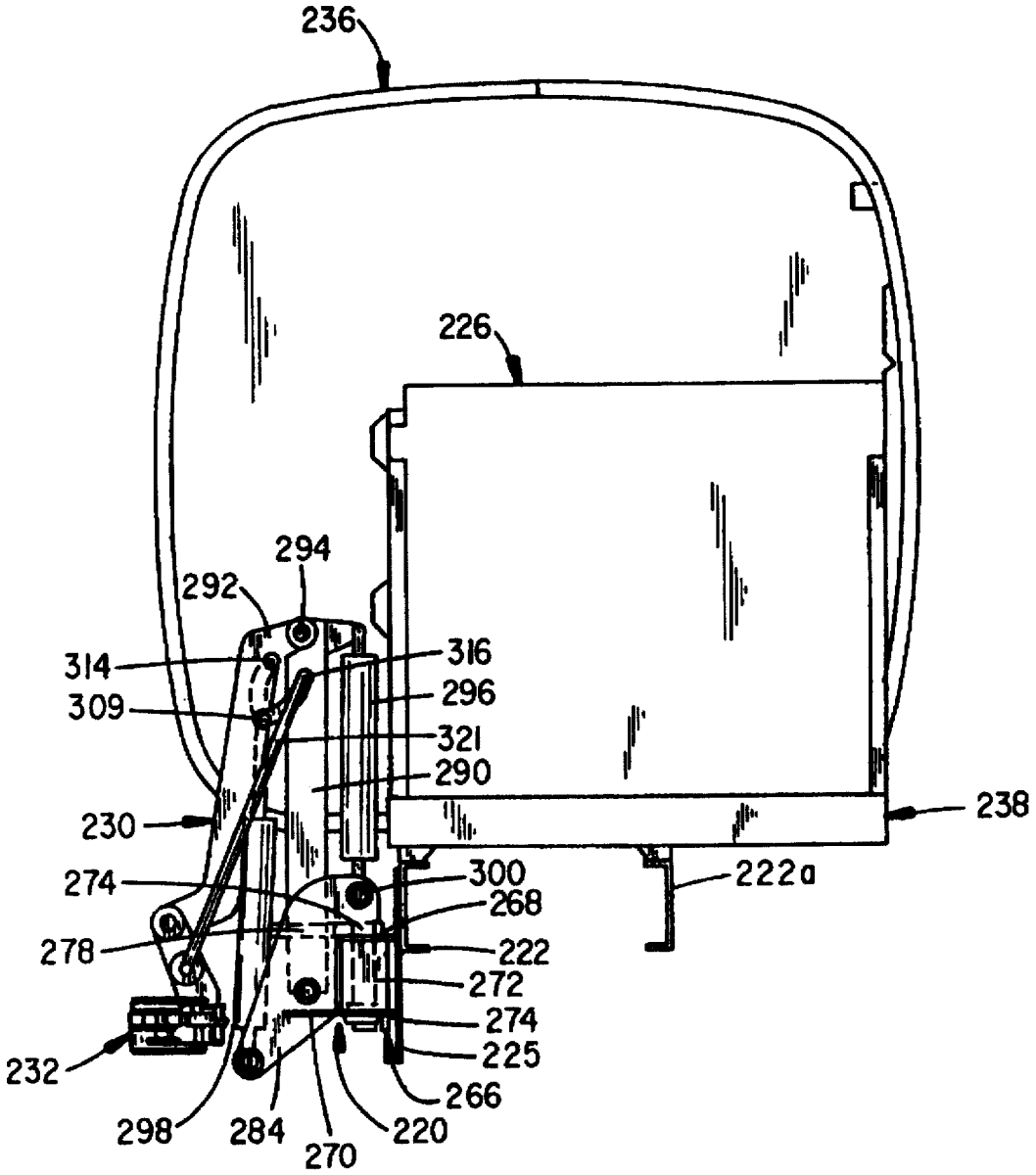
FIG. 11 depicts an enlarged view, partially in section, taken substantially along lines 11—11 of FIG. 9.

As shown in FIGS. 9–11, the swivel mount 220 includes heavy base plate 225 affixed to frame member 222. An arm base pivot support structure is shown at 266 including spaced upper and lower flanges 268 and 270 through which a pivot shaft 272 is journaled for rotation on spaced bearings as at 274. An operable swivel arm or connecting link 278 is keyed to the pivot shaft 272 and the base pivot cylinder 280 is connected between the free end of the swivel operating link 278 and a wrist pin mount at 282.

Figure 13A:
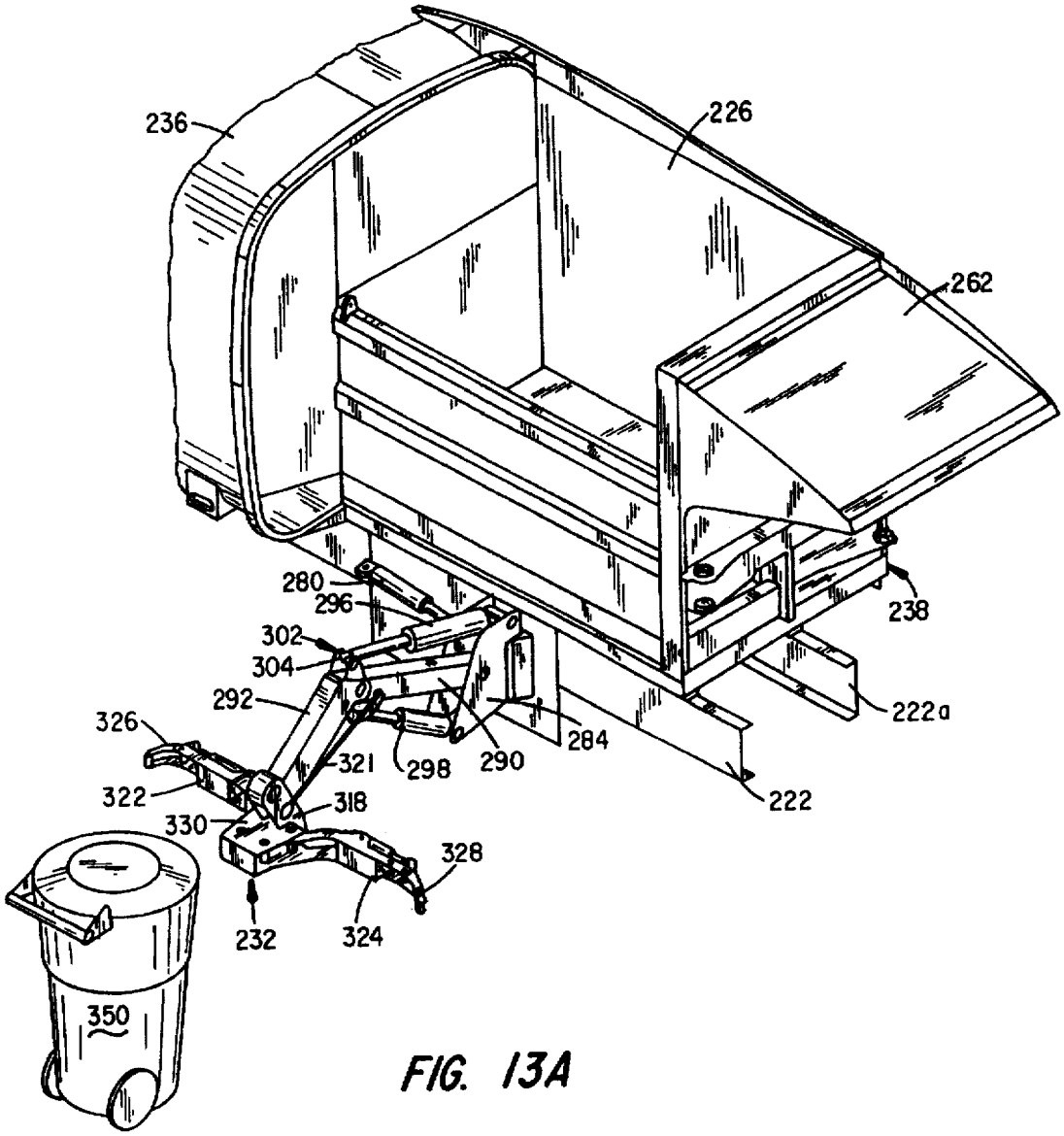
FIG. 13A is a fragmentary perspective view similar to that of FIG. 12 showing the arm extension and grabber seizing functions with respect to the container handling system as it addresses a curbside container.

The articulated arm system is mounted between a pair of spaced heavy gauge arm mounting plates or lugs 284 and 286 (FIG. 13A). Extension and retraction of the cylinder 280 rotates the shaft 272 thereby pivoting the dual plate arm support system about forward and aft in relationship to the vehicle chassis.

The container handling system itself is best presented with reference to FIGS. 13A–16. The articulated arm 230 includes inner and outer segments 290 and 292 generally sequentially and vertically pivotally connected at a central joint 294. The segment 292 carries the grabber system 232. The joints of the system, particularly those of the articulated arm, may be provided with resilient bushings to cushion the operation of the system and increase the life of the mechanical joints. These may be of a rubber compound or other durable resilient material of a durometer to reduce shock yet not affect mechanical joint performance.

The segmented arm 230 is operated by a pair of linear actuators, preferably hydraulic cylinders, including an upper or reach controlling cylinder 296 and a lower or lift cylinder or lift/tipping or dumping cylinder 298, each being mounted with a free end and a pivotally connected fixed end. The actuator 296 is pivotally connected between a wrist pin pivot joint 300 connected between mounting plates 284 and 286 and a second wrist pin type pivot joint 302 connected between spaced lugs 304 and 306 fixed at the outer end of the segment 290. The lift cylinder or actuator 298 is also connected at its fixed end pivotally between the mounting plates 284 and 286 at 308. The free end of the actuator 298 is connected to a common pin member 309 that joins the common joint of spaced pairs of arcuate linkage elements connected between the arm elements 290 and 292 and on either side thereof, one pair of which is shown at 310 and 312. Element 310 is connected to arm segment 292 at 314 and element 312 to segment 290 at 316. A grabber mounting and pivot segment 318 pivotally connects the grabber system 232 to the free end of arm segment 292 at 320. A pair of spaced operating following rods or linkage bars one of which is shown at 321, are leveraged between an offset connection to a connecting link segment 318 at 323 and a common connection at the linkage element arm segment joint 316. These flank the arm segments 290, 292 on either side and with the linkage members 310, 312 pivot the grabber 232 for dumping as the lift cylinder 298 is extended as will be described.

Figure 13B:
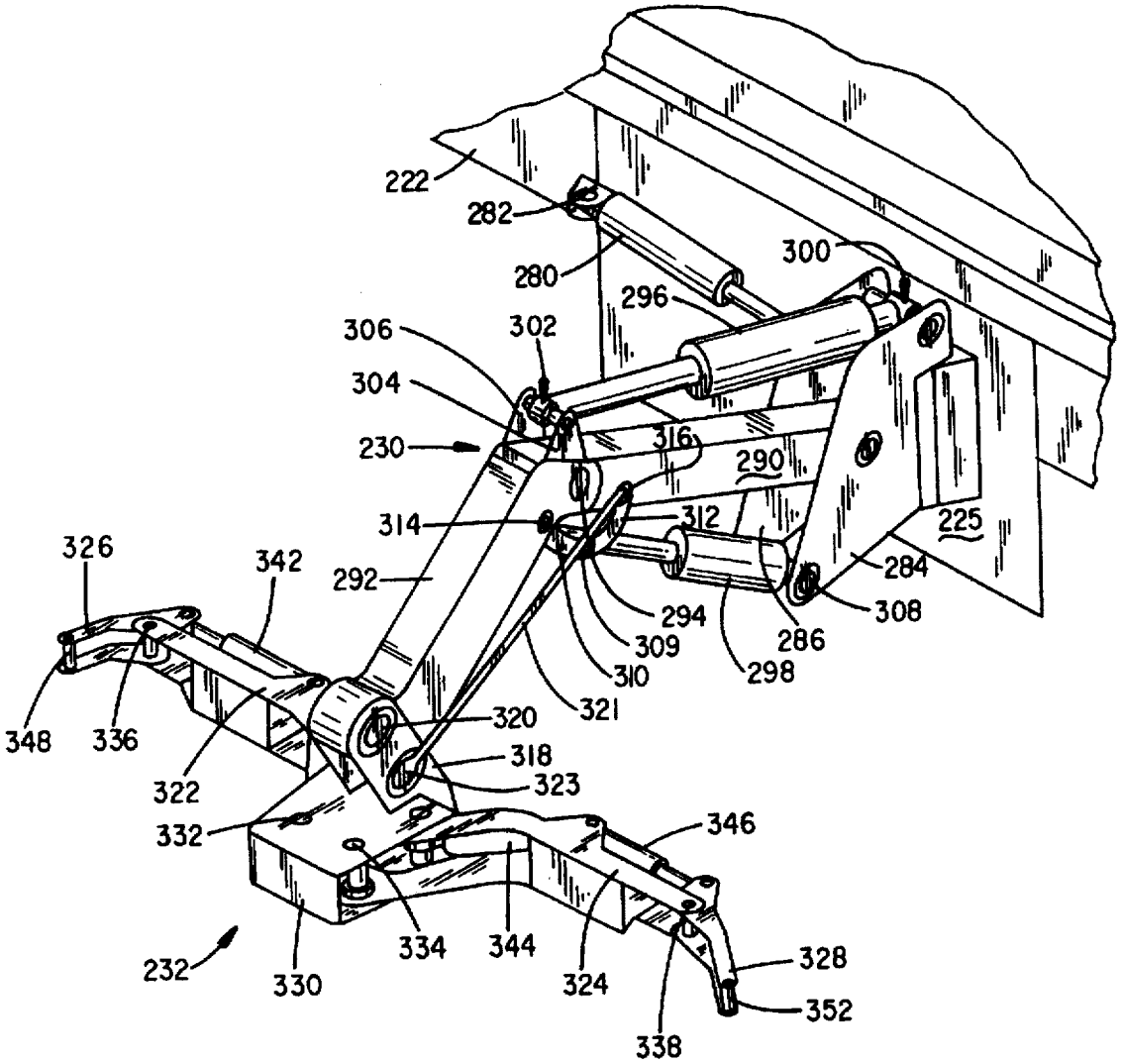
FIG. 13B is an enlarged fragmentary perspective view illustrating the details of the container handling mechanism of FIG. 13A.
Figure 14:
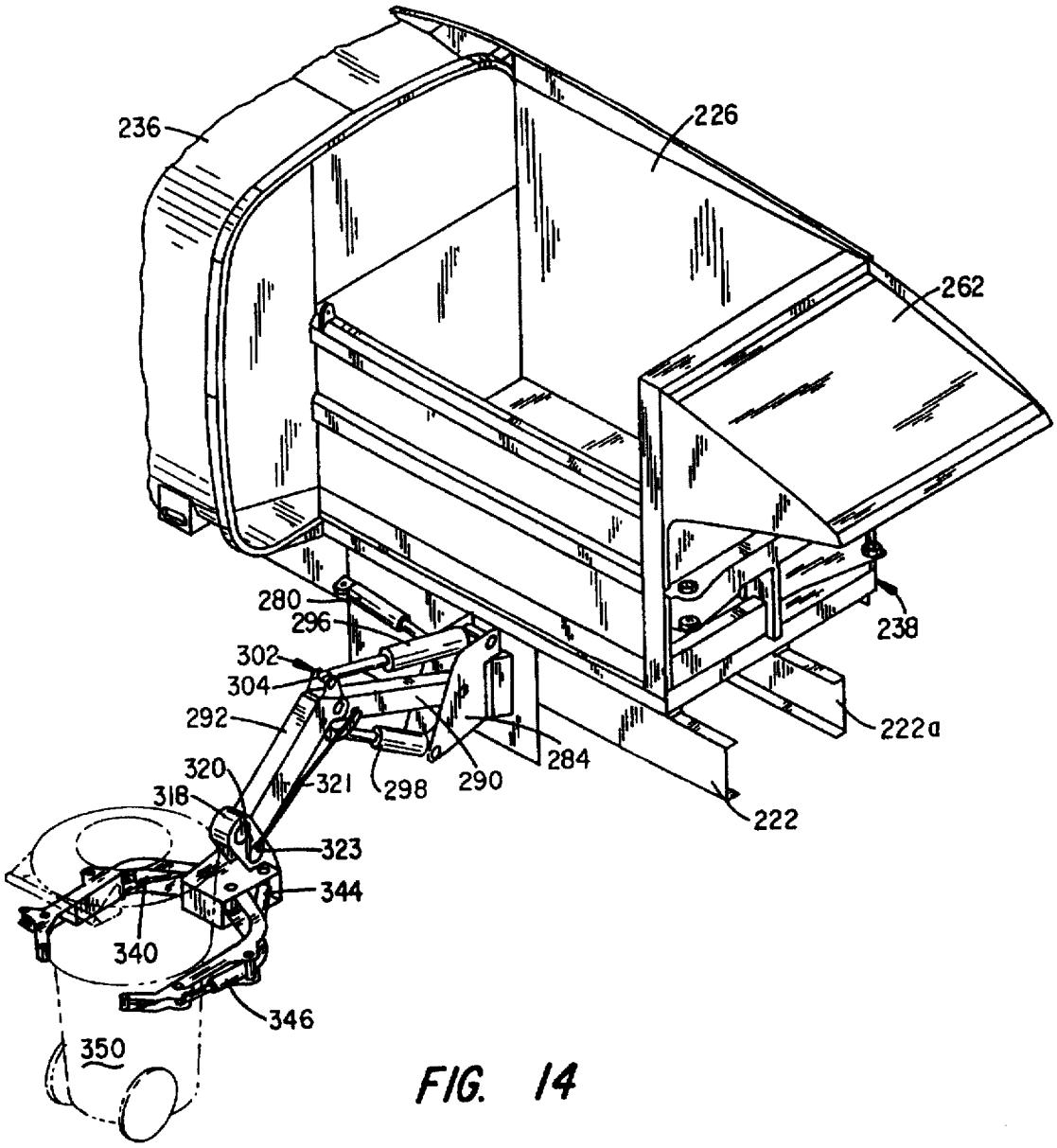
FIG. 14 is a view similar to that of FIG. 13A showing a container (in phantom) as having been seized by the grabber.
Figure 15:
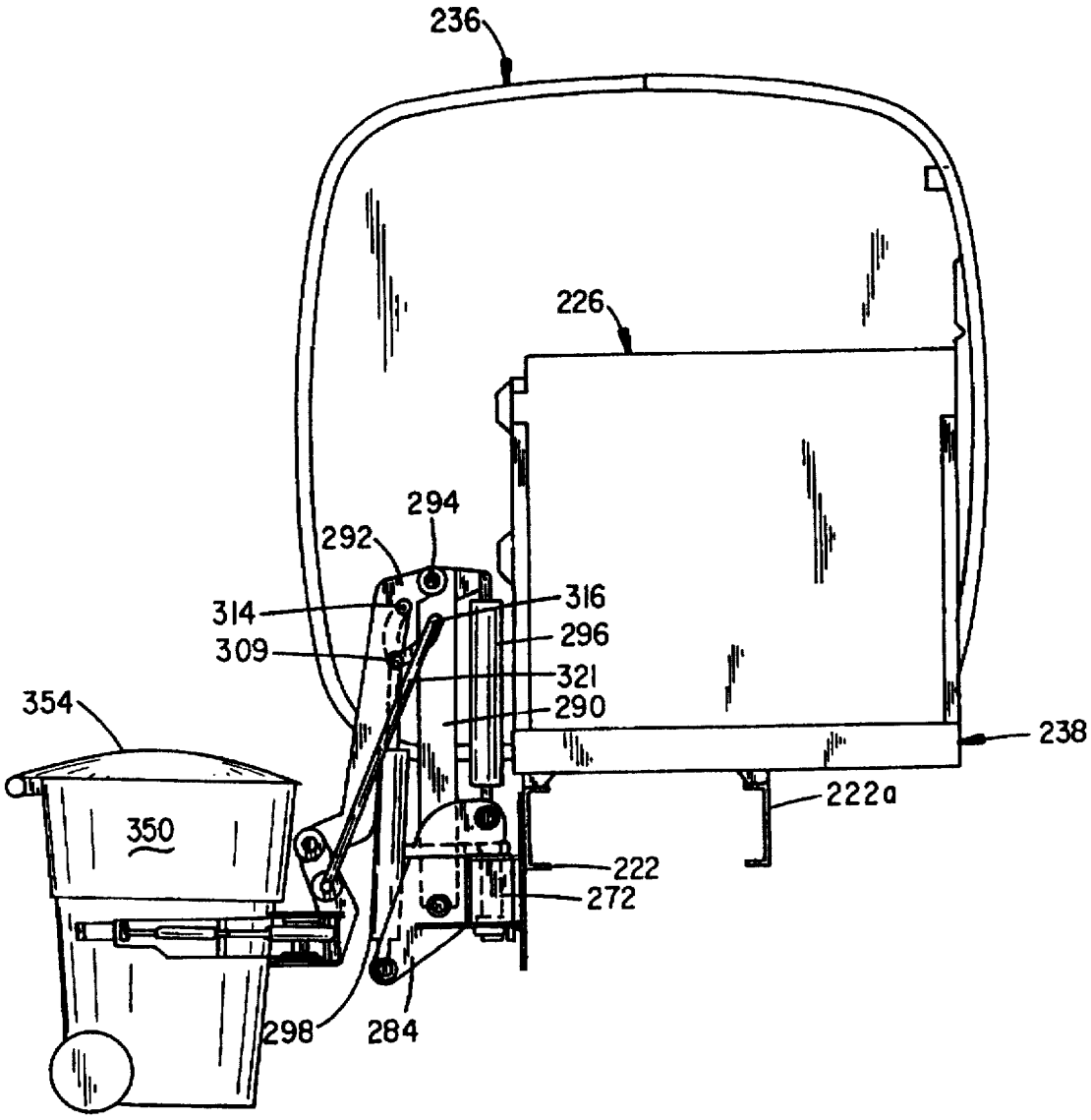
FIG. 15 is a view similar to that of FIG. 11 depicting the arm retracted and the grabber holding the seized container in preparation for dumping and tipping.

The grabber 232, as shown, includes opposed digits or compound jaw elements having inner segments 322 and 324 flanked by outer segments 326 and 328. The inner segments 322 and 324 are pivotally connected to a base element 330 at 332 and 334, respectively, and outer segments 326 and 328 likewise are pivotally connected to the respective inner elements at 336 and 338. The jaw elements are operated to close or open to seize or release a rigid container, as at 350, by pivotally connected, oppositely disposed pairs of linear actuators, including inner and outer actuators 340 and 342 operating connected jaw elements 322 and 326, respectively, and inner and outer actuators 344 and 346, in a like and symmetric manner, operating respective jaw elements 324 and 328 (FIGS. 13B and 14). Roller members 348 and 352 mounted in the jaw elements 326 and 328 guide the outer digit or jaw segments in following the periphery of a container of interest to be seized. The roller member may be made from a rubber material or plastic material such as high density polyethylene.

The operation of the container handling system of FIGS. 9–16 is best illustrated by the figure sequence 12–16. The system is shown in the retracted stowed position in FIG. 12 with the grabber jaws fully opened to minimize lateral protrusion with respect to the vehicle. The offset hopper construction, while optional, of course, accommodates the side mounting quite successfully. This is particularly noticeable in the FIGS. 10 and 11 where protrusion of the stowed device is minimal.

Figure 12:
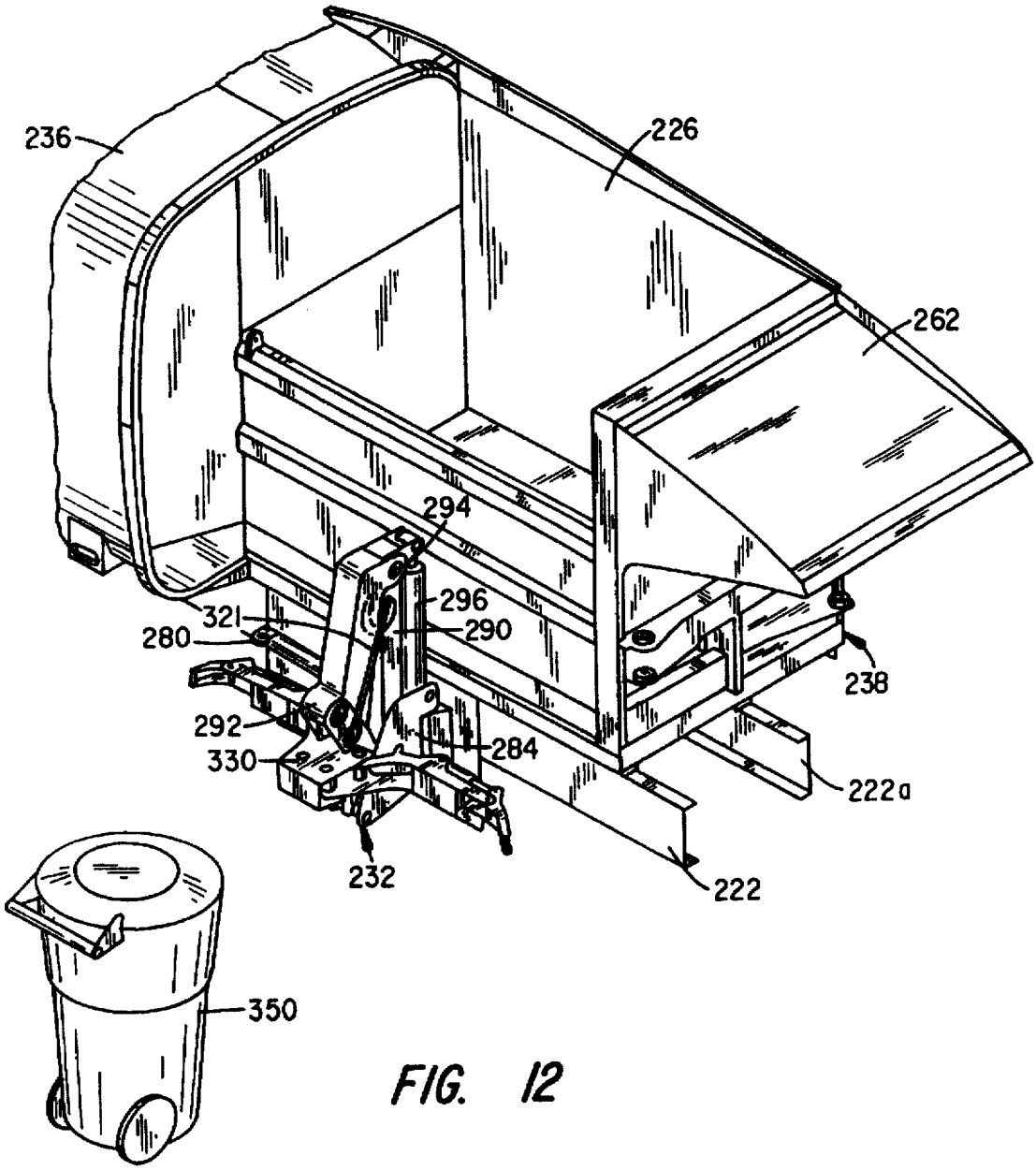
FIG. 12 is a fragmentary perspective view of the embodiment of FIG. 9 showing the container handling system in the stowed position.

In the stowed or nested position, the inner and outer arm segments are fully open or extended. Note that the reach controlling cylinder 296 is fully retracted and the lift cylinder 298 is generally in a partially extended position (FIGS. 11 and 12). In FIGS. 13A and B, the compound arm is shown partially extended, the grabber jaws approaching the rigid container 350. In FIG. 14, with the jaws of the gripper shown partially in phantom, the container 350 has been addressed and seized. In this sequence, cylinder 296 is extended to accomplish reach while cylinder 298 remains at about the same length. It is noteworthy, however, that the length of cylinder 298 may also be varied to adjust the height of the grabber as desired. One distinct advantage of the unique linkage configuration is that in this manner it enables easy adjustment of the grabber height as well as reach adjustment which adds versatility to the container pick-up ability of the system. Once the container is reached, the inner and outer cylinder actuators of the gripper mechanism are expanded to cause the articulated jaws to surround and capture the container which, while illustrated as round in cross-section, may be of any geometric section as has been previously described.

Figure 16:
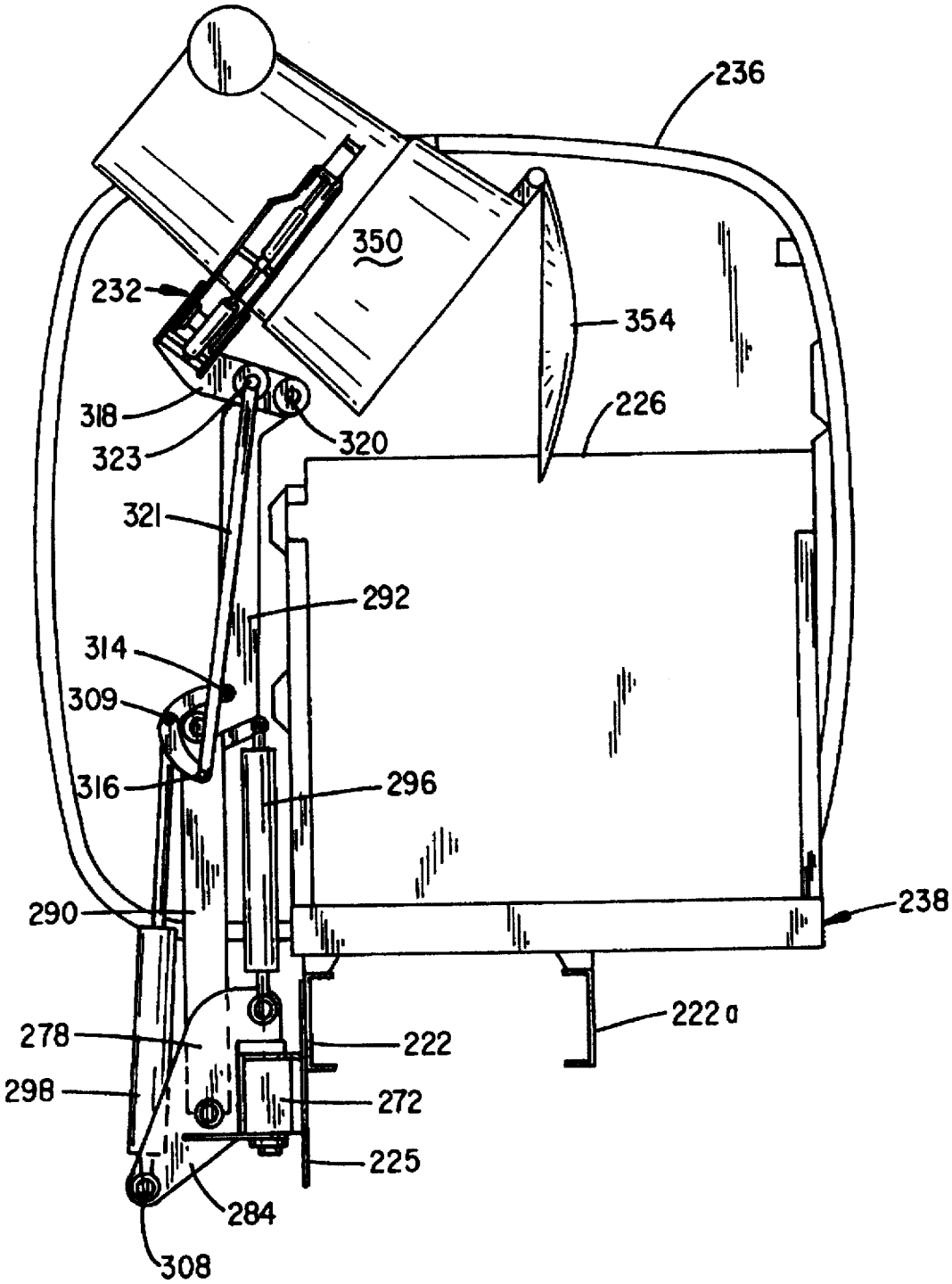
FIG. 16 is a view similar to that of FIG. 15 illustrating the seized container in the raised, inverted or tipped posture.

FIG. 15 shows the arm again fully retracted with the captured container retrieved and held next to the collection vehicle ready for tipping. FIG. 16 depicts the container 350 fully tipped with hinged top 354 flapped open for dumping. In the tipping operation, the lifting/tipping cylinder 298 is fully extended while reach controlling cylinder 296 remains retracted. The pairs of linkage elements 310 and 312 rotate and transfer forces around the pivot 294 and allow sufficient rotation in cooperation with the operation of the follower rods as at 321 to pivot the grabber system 232 carrying the lifted container 350 so that tipping of the container to open lid 354 and discharge the contents does not occur until the container is lifted in a stable manner and located above the charging hopper 226.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

For example rotary actuator means may be used to operate the swivel system or one or more of the pivot joints in the articulated arms and in the grabber mechanism of the embodiment as shown in FIGS. 13A–16 as previously described in relation to FIGS. 4 and 5. These may be in the form of compact electric motors or other mechanical servo systems employed and connected in a well-known manner.

It should also be appreciated that, although the container handling mechanism has been illustrated with reference to refuse collection vehicles in the detailed embodiment, the system may be employed in any circumstance for which such a device is useful. This also includes the use of the articulated arm and grabber in a configuration that is not swivel mounted. The inventive advances residing in the articulated arm and grabber combination are believed to be universally applicable to such devices regardless of application.

What is claimed is:

1. A system for approaching, grabbing, lifting, tipping and replacing containers, comprising:

a) a mechanized swivel mount fixed with reference to a material receiving location, and adapted for angular displacement in a first plane;

b) a mechanized articulated arm attached at one end to said swivel mount for angular displacement in said first plane and having a plurality of segments disposed to pivot in a second plane which intersects said first plane, said articulated arm being operable between stowed, extended, retracted, lift and inverting positions;

c) wherein said articulated arm includes an inner arm segment and an outer arm segment wherein said inner arm segment has a fixed end fixed to said swivel mount mechanism and includes a mounting pivot joint for pivoting, said inner arm segment including a free end, in said second plane, said arm including a linking pivot joint linking the free end of said inner arm segment to one end of said outer arm segment, said outer arm segment having a free end;

d) mechanized grabber means pivotally connected to said free end of said outer segment of said articulated arm for grasping and releasing a container of interest;

e) coordinating linkage means connected between said articulated arm and said grabber means for automatically positioning said grabber means relative to said articulated arm;

f) a plurality of linear actuating means for operating said articulated arm means including a reach actuator for operating said inner arm segment for extending and stowing said articulated arm means, and a lift and tip actuator for operating said outer arm segment for raising said arm and rotating said grabber means to tip a container held by said grabber means; and (g) wherein said coordinating linkage means includes link means connected between said inner arm segment and said outer arm segment and offset auxiliary follower rod means connected between said inner arm at said link means and said grabber means at a point spaced from the pivot point thereof to operate said follower rod means as said outer arm segment pivots in relation to said inner arm segment to tip said grabber means.

2. The apparatus of claim 1 wherein said link means comprises rotating linkage means including spaced pairs of consecutive inner and outer curved links having respective fixed ends pivotally connected respectively flanking said inner and said outer arm segments and free ends connected together by a common cross pin, said cross pin also carrying one end of said lift and tip actuator such that linear operation of said actuator also rotates said linkage.

3. The apparatus of claim 2 wherein said follower rod is connected to said rotating linkage where it joins said inner arm segment.

4. The apparatus of claim 1 wherein said follower rod also operates to maintain the grabber in a substantially level disposition during the grabbing and replacing operation.

5. The apparatus of claim 1 wherein said actuating means are hydraulic cylinders.

6. The apparatus of claim 3 wherein said actuating means are hydraulic cylinders.

7. The apparatus of claim 1 wherein said grabber means comprises:

a) a base element;

b) a pair of opposed grasping arms each having a plurality of sequentially articulated grasping arm members aligned in spaced relation for grasping and releasing a container of interest, each grasping arm of said pair of opposed grasping arms having a first end pivotally connected to said base element: and c) actuating means for operating said pair of opposed grasping arms between an open position and a grasping position.

8. The apparatus of claim 1 wherein said swivel mount is carried by a top loading refuse truck.

9. A system for approaching, grabbing, lifting and tipping containers, comprising:

a) a mechanized articulated arm attached at one end and having a plurality of segments disposed to pivot in a plane, said articulated arm being operable between stowed, extended, retracted, lift and inverting positions;

b) wherein said articulated arm includes an inner arm segment and an outer arm segment wherein said inner arm segment has a fixed end pivotally fixed to a reference point by a mounting pivot joint, said inner arm segment having a free end, said arm including a linking pivot joint linking the free end of said inner arm segment to one end of said outer arm segment, said outer arm segment having a free end;

c) mechanized grabber means pivotally connected to said free end of said outer segment of said articulated arm for grasping and releasing a container of interest;

d) coordinating linkage means connected between said articulated arm and said gabber means for automatically positioning of said grabber means relative to said articulated arm;

e) a plurality of linear actuating means for operating said articulated arm means including a reach actuator for operating said inner arm segment for extending and stowing said articulated arm means, and a lift and tip actuator for operating said outer arm segment for raising said arm and rotating said grabber means to tip a container held by said grabber means; and (g) wherein said coordinating linkage means includes link means connected between said inner arm segment and said outer arm segment and offset auxiliary follower rod means connected between said inner arm at said link means and said grabber means at a point spaced from the pivot point thereof to operate said follower rod means as said outer arm segment pivots in relation to said inner arm segment to tip said grabber means.

10. The apparatus of claim 9 wherein said link means comprises rotating linkage means including spaced pairs of consecutive inner and outer curved links having respective fixed ends pivotally connected respectively flanking said inner and said outer arm segments and free ends connected together by a common cross pin, said cross pin also carrying one end of said lift and tip actuator such that linear operation of said actuator also rotates said linkage.

11. The apparatus of claim 10 wherein said follower rod is connected to said rotating linkage where it joins said inner arm segment.

12. The apparatus of claim 11 wherein said linear actuators are hydraulic cylinders.

* * * * *